US007570209B2

(12) United States Patent
Shi et al.

(10) Patent No.: US 7,570,209 B2
(45) Date of Patent: Aug. 4, 2009

(54) ANTENNA SYSTEM INCLUDING A POWER MANAGEMENT AND CONTROL SYSTEM

(75) Inventors: Fong Shi, Bellevue, WA (US); Lixin Cai, Ravensdale, WA (US); Ming Chen, Bellevue, WA (US); Mike Bemes, Kenmore, WA (US); Victor Starkovich, Maple Valley, WA (US); Mark Davis, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 180 days.

(21) Appl. No.: 11/739,741

(22) Filed: Apr. 25, 2007

(65) Prior Publication Data

US 2008/0268790 A1 Oct. 30, 2008

(51) Int. Cl.
*H01Q 3/24* (2006.01)

(52) U.S. Cl. ..... 342/372; 342/374

(58) Field of Classification Search ..... None
See application file for complete search history.

(56) References Cited

U.S. PATENT DOCUMENTS 5,008,680 A * 4/1991 Willey et al. ..... 342/372
5,654,859 A 8/1997 Shi
6,097,335 A * 8/2000 Cassen et al. ..... 342/175
6,573,863 B2 * 6/2003 Vail et al. ..... 342/372
7,126,541 B2 * 10/2006 Mohamadi ..... 343/700 MS
7,187,325 B2 * 3/2007 Subotic et al. ..... 342/374
7,190,090 B2 3/2007 Shi
2006/0222101 A1 * 10/2006 Cetiner et al. ..... 375/267

FOREIGN PATENT DOCUMENTS

WO WO 0108259 A1 * 2/2001

* cited by examiner

*Primary Examiner*—Gregory C Issing
(74) *Attorney, Agent, or Firm*—Charles L. Moore; Moore & Van Allen, PLLC

(57) ABSTRACT

An antenna system may include a reconfigurable array antenna system including a plurality of elements each capable of radiating and receiving electromagnetic energy. The antenna system may also include an electronically reconfigurable power management and control system to selectively power each of the plurality of elements to generate a desired beam pattern.

36 Claims, 3 Drawing Sheets

ANTENNA SYSTEM INCLUDING A POWER MANAGEMENT AND CONTROL SYSTEM

BACKGROUND OF THE INVENTION

The present invention relates to phased array antennas, and more particularly to an antenna system including a power management and control system.

Phased array antennas may be used for satellite and line-of-sight communications, and other applications related to radar/sensors, electronic warfare (EW) or the like. Radiation patterns or beams from a phased array antenna may typically be controlled or steered electronically by varying the time-delay or phasing of electrical signals to individual transmit and receive elements forming the array antenna without moving any parts. Accordingly, a power management and control system for such antenna systems needs to be efficient particularly in satellite or other space vehicle applications, terrestrial mobile vehicle applications or other applications where capacity may be limited and efficient or optimum use of power is highly desirable. Additionally, such systems are desirably reconfigurable during a mission and systems' reliability can directly impact overall system reliability and performance. For mission critical space applications in particular, electronic subsystems must be able to tolerate a certain amount of single component failures and the failures must be contained from propagating and affecting other circuits or components.

BRIEF SUMMARY OF THE INVENTION

In accordance with an embodiment of the present invention, an antenna system may include a reconfigurable array antenna system including a plurality of elements each capable of radiating and/or receiving electromagnetic energy. The antenna system may also include an electronically reconfigurable power management and control system to selectively power each of the plurality of elements to generate a desired beam pattern without exceeding the system power limits.

In accordance with another embodiment of the present, a power management and control system for an array antenna system may include a host controller to control power to the array antenna system. The power management and control system may also include a beam steering controller to electronically steer the desired beam pattern generable by the array antenna system.

In accordance with another embodiment of the present, invention, a method of controlling antenna elements in an array antenna system may include selectively powering each of a plurality of elements of a reconfigurable phased array antenna system to generate a desired beam pattern within the system's total power allocation. The method may also include managing power consumption in each antenna sub-array of a plurality of antenna sub-arrays in the phased array antenna system.

Other aspects and features of the present invention, as defined solely by the claims, will become apparent to those ordinarily skilled in the art upon review of the following non-limited detailed description of the invention in conjunction with the accompanying figures.

DETAILED DESCRIPTION OF THE INVENTION

The following detailed description of embodiments refers to the accompanying drawings, which illustrate specific embodiments of the invention. Other embodiments having different structures and operations do not depart from the scope of the present invention.

Figure 1:
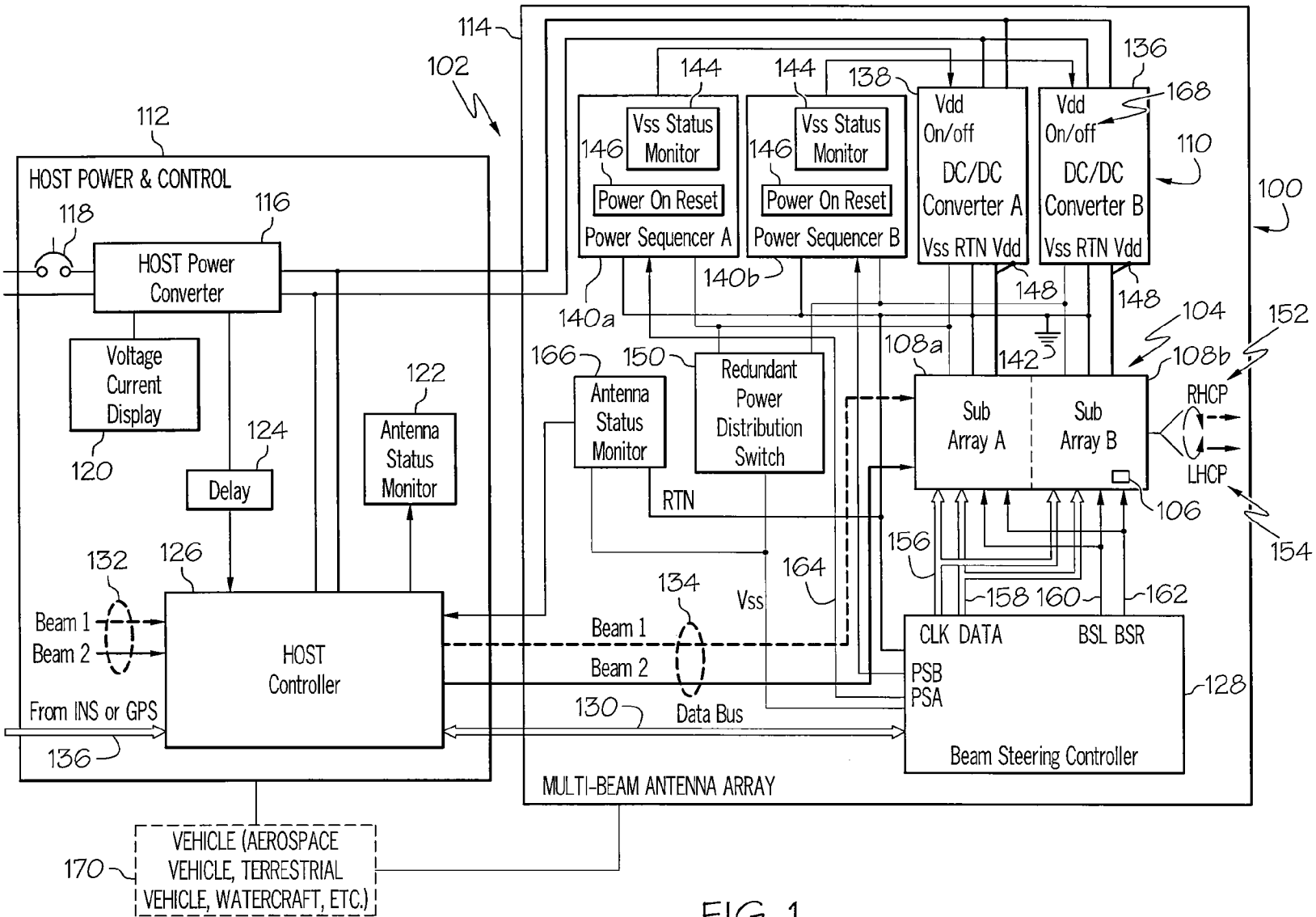
FIG. 1 is a schematic diagram an example of an antenna system including a power management and control system in accordance with an embodiment of the present invention.

FIG. 1 is a schematic diagram of an example of an antenna system 100 including a power management and control system 102 in accordance with an embodiment of the present invention. The antenna system 100 may also include a reconfigurable array antenna system 104 including a plurality of elements 106 that may be grouped in an array or multiple antenna sub-arrays or modules, such as sub-array 108*a* and sub-array 108*b*. The elements 106 are capable of being electronically steered for radio frequency communications.

The plurality of elements 106 may include transmit elements capable of radiating electromagnetic energy or transmitting communications signals, receive elements capable of receiving electromagnetic energy or communications signals, or the elements 106 may be able to both transmit and receive electromagnetic radiation or signals. The elements 106 may include Monolithic Microwave Integrated Circuit (MMIC) devices formed or grouped in the antenna sub-arrays 108 or antenna modules.

As will be described, the antenna system 100 provides a redundant power management and distribution architecture 110 for the multiple sub-array, multi-beam phased array antenna system 104. The antenna system 100 may include a host power and control module 112, circuit or subsystem and a multi-beam antenna array module 114, circuit or subsystem.

The host power and control module 112 may include a host power converter 116 to provide step-down power conversion to reduce a line bus voltage to an intermediate voltage. The step-down power conversion may be necessary because of the physical separation between the host controller 112 and the externally installed array antenna system 104. Additionally, a power conversion ratio and low voltage and high voltage current requirements may be optimized for the multi-beam antenna array module 114 electronics by the host power converter 116.

An inline current interruptor 118, circuit breaker or similar device may connect the host power converter 116 to a voltage bus to protect the host power and control module 112 and its load or array module 114. A voltage and current display 120 may present the host or line side voltage and current for observation by a user or operator or the line side voltage and current may be transmitted to a remote location for monitoring, such as in space vehicle applications.

The host power and control module 112 may also include an antenna status display 122 to display a status of the array antenna system 104 to a user or operator. Alternatively, the antenna status also may be transmitted to a remote location as in space applications.

A delay module 124 or circuit may be connected between the host power converter 116 and a host controller 126. The host controller 126 may be connected to a beam steering controller 128 in the multi-beam antenna array system 114 by a data bus 130. The delay module 124 may provide proper timing between the host controller 126 and the beam steering controller 128 for initial establishment of bus communications over the data bus 130.

The host controller 126 may receive radio frequency (RF) signals or data for controlling the multiple beams that may be generated by the array antenna system 104. In the example illustrated in FIG. 1, the host controller 126 may receive inputs 132 or RF signals or data for a beam 1 and a beam 2 that may be produced by antenna sub-arrays 108*a* and 108*b*, respectively. The system 102 is scalable to accommodate any number of antenna sub-arrays 108 and may receive multiple inputs 132 for controlling different beams from any number of sub-arrays 108. The RF signals may be conditioned and transferred by the host controller 126 to the sub-arrays 108 via RF signal lines 134. Elements 106 may be selectively controlled within the sub-arrays 108 and specific sidelobe and antenna beam shapes may be generated by powering up selected sub-arrays 108 or elements 106 or powering-down selected sub-arrays 108 or elements 106 as will be described in more detail with reference to FIGS. 3A-3D.

For beam pointing, the host controller 126 may also receive location and navigation data from an inertial navigation system, global positioning system, or other positioning or navigation system via a bus 136. The location and navigation data may be conditioned and relayed by the host controller 126 to the beam steering controller 128 via the data bus 130.

The host power converter 116 may be connected to at least two antenna power converters 136 and 138 that may be in the multi-beam antenna array module 114. The two antenna power converters 136 and 138 provide redundancy and permit the power management and control system 102 to be electronically reconfigured for reliably powering the antenna sub-arrays 108 as further described herein. Each of the antenna power converters 136 and 138 may be direct current (DC) to DC power converters. The antenna power converters 136 and 138 may convert the intermediate voltage from the host power converter 116 to suitable operating voltages for the elements 106 or MMIC devices.

The multi-beam antenna array module 114 may also include a number of power sequencers 140 corresponding to the number of antenna sub-arrays 108 or antenna modules. Accordingly, the multi-beam antenna array module 114 may include a power sequencer 140 for every antenna sub-array 108. For purposes of simplicity of illustrating and describing the present invention, only two power sequencers 140 and two antenna sub-arrays 108 are shown in the exemplary embodiment of the present invention illustrated in FIG. 1. However, the system 102 is scalable and may include any number of antenna sub-arrays 108 and corresponding power sequencers 140 depending upon the expected application or applications of the system 102 and any spatial limitations of the platform or vehicle with which the system 100 may be used.

The power sequencers 140*a* and 140*b* may be respectively connected to the antenna power converters 136 and 138 to control a positive voltage supply (Vdd) of each antenna power converter 136 and 138 by monitoring a negative output voltage (Vss) of each converter 136 and 138. The positive voltage supply (Vdd) and the negative voltage supply or output voltage (Vss) may be respectively connected from each of the converters 136 and 138 to the respective antenna sub-arrays 108*a* and 108*b*. The positive voltage supply (Vdd) may be positive or have a positive polarity relative to a return or common ground 142 of each of the antenna power converters 136 and 138, and the negative output voltage (Vss) may be negative or negatively polarized relative to the return or common ground 142.

Each of the power sequencers 140 may include a voltage status monitoring module 144 to respectively monitor the status of each converter's negative output voltage (Vss) to control the application of the positive output voltage (Vdd) to each of the antenna sub-arrays 108. Monitoring and measuring the negative output voltage (Vss) prevents excess current drawn by the antenna elements 106 or MMIC devices which could potentially damage the devices. The voltage status monitor 144 may generate or cause to be generated a suitable reset signal to hold the positive output voltage (Vdd) off during startup of the antenna system 104 until the negative output voltage (Vss) is at a proper level to prevent any damage to the antenna elements 106 or MMIC devices.

Each power sequencer 140 may also include a power on reset module 146. The power on reset module 146 may generate or cause to be generated a reset signal to hold the positive voltage supply (Vdd) of any one of the converters 136 or 138 off, when the converter 136 or 138 is coupled to at least one of the antenna sub-arrays 108 to supply power thereto, in response to the negative output voltage (Vss) of the converter 136 or 138 dropping below an acceptable threshold voltage during normal operation of the antenna system 100.

Each of the antenna power converters 136 and 138 may also include a crowbar switch 148 or a similar device at the output terminals of the positive voltage supply (Vdd). The crowbar switch 148 may clamp the positive voltage supply (Vdd) output down before the negative voltage supply (Vss) output during a power down operation to prevent excess current drawn from the positive voltage supply (Vdd) by the antenna elements 106 or MMIC devices which could potentially damage the devices.

The multi-beam antenna array module 114 may also include a redundant power distribution switch 150 to connect power converters 136 and 138 to provide power to antenna status monitor 166 and the beam steering controller 128. An example of a redundant power distribution system that may be used for the redundant power distribution switch 150 and operation of such a switch or system is described in U.S. Pat. No. 5,654,859, entitled "Redundant Power Distribution System," issued Aug. 5, 1997 to Fong Shi and in U.S. Pat. No. 7,190,090, entitled "Redundant Power Distribution System," issued Mar. 13, 2007 to Fong Shi. Both of these patents are assigned to the same assignee as the present invention and are incorporated herein by reference. The redundant power distribution switch 150 provides redundant power to its loads as long as one of the power converters 136 or 138 is in operation.

In another embodiment of the present invention, not shown in the drawings, a power switch may be associated with each antenna sub-array 108 to connect a chosen one of the at least two converters 136 and 138 to selected ones of the antenna sub-arrays 104. Each power switch may respectively connect the negative output voltage (Vss) and the positive output voltage (Vdd) of the chosen one of the converters 136 and 138 to be operational to the antenna sub-arrays 108 selected to be powered during a particular mission or operation. The beam steering controller 128 may control a main power control switch that is connected to each of the power switches associated with each antenna sub-array 108 and to the negative output voltage (Vss) of each antenna power converter 136 and 138.

Accordingly, the embodiments of the present invention provide a redundant and electronically reconfigurable power management and distribution architecture and control system 102 for a multiple sub-array multi-beam phased array antenna system 104 or similar system. The power management, distribution and control system 102 is capable of isolating a failure and continuing to feed power to the antenna system 104. The system 104 is capable of self reconfiguring at the sub-array level 108, simultaneously producing a left hand and a right hand circularly polarized beam pattern 152 and 154, respectively, or either a left hand pattern 154 or right hand pattern 152 when only one circular polarization is required. For power conservation, one or more of the total available number of antenna sub-arrays 108 or beams can be turned off remotely when not needed during a particular mission or operation. The system 100 can also be easily implemented in other array architectures with more than two simultaneous beams and with multiple sub-arrays.

As previously described, the phased array antenna system 104 is a redundant design at the sub-array 108 or module level. The antenna system 104 may consist of a large number of individual sub-arrays 108 and may, therefore, be able to lose a small portion of the antenna sub-arrays 108 or modules, as long as the failed modules do not affect the power and control of the entire system 100. Power being supplied to the antenna system 104, however, may be the most critical functional block because its reliability has a direct impact on the overall system reliability. For mission critical space applications or similar application, electronic systems must be able to tolerate a single component failure and the failure must be contained from propagating and affecting other components, circuits or subsystems. For cost, weight and performance trade-offs, N numbers of redundant power switches and a minimum of two identical power supplies or converters may be necessary for an N sub-array antenna system to tolerate component failure beyond the antenna sub-array or module level. As described, the redundant power management, distribution and control system 102 of the embodiments of the present invention are capable of tolerating at least one power supply failure and being able to be reconfigured to maintain operation. Accordingly, should one of the minimum of two DC to DC antenna power converters 136 and 138 become inoperable, the other converter may continue to provide uninterruptible power for the loads.

The beam steering controller 128 may receive beam pointing commands and reconfiguration control commands for sub-array and beam switching from the host controller 126. For beam pointing commands and periodic update data, the beam steering controller 128 may calculate and load the phase shifts or time delays to individual elements 106 or MMIC devices. Beam forming may be accomplished through a predetermined number of rows and columns of dedicated clock lines 156 and data lines 158. The predetermined number of rows and columns of dedicated clock lines 156 and data lines 158 may be dependent upon the number of individual antenna elements 106 or MMIC devices that may need to be addressed or controlled to provide the desired beam pattern or radiation pattern. For example, an antenna array system similar to the antenna array system 200 illustrated in FIG. 2 may have 128 elements packaged into sixteen element modules 202 with eight elements 204 in each module 202. In this example, there may be sixteen clock lines 206 and sixteen data lines 208 to address each of the sub-arrays 210 and 212.

For polarization switching, the beam steering controller 128 may simultaneously send all the control commands via two discrete control lines, beam steering line left (BSL) 160 and beam steering line right (BSR) 162, to the antenna elements 106 or MMIC devices in the antenna sub-arrays 108 for the formation of the right hand circular polarized radiation pattern 152 and the left hand pattern 154.

The beam steering controller 128 may also assert control through discrete power sequencer control lines 164 from the beam steering controller 128 to each of the power sequencers 140 to respectively command and control the positive output voltage (Vdd) from the DC to DC antenna power converters 136 and 138 or whichever converter may be active.

The multi-beam antenna array module 114 may also include an antenna status monitor module 166 to monitor an operational status of the antenna array system 104 and to report the operational status to the host controller 126. The operational status of the antenna array system 104 may be presented on the antenna status display 122. The operational status that may be displayed may include but is not necessarily limited to operational parameters, such as temperature at various locations on an antenna base plate where the antenna elements 106 or MMIC based radio frequency (RF) devices are directly attached, power conditions, power consumption of the entire antenna system 104, which sub-arrays 106 are active, or similar information that may be beneficial in monitoring the system performance and controlling the system 100.

Each antenna power converter 136 and 138 may include a positive voltage (Vdd) On/Off control 168 for the converter's main output voltage. The power sequencer 136 or 138 may control the positive output voltage (Vdd) using the On/Off control 168 by monitoring the status of the converter's negative output voltage (Vss). As previously described, the positive output voltage (Vdd) may be positive with respect to the return or common ground of the converter 136 or 138, and the negative output voltage (Vss) may be negative with respect to the same return of the same converter.

In accordance with an embodiment of the present invention, the power management and control system 102 and reconfigurable array antenna system 104 may be mounted to a vehicle 170. The vehicle 170 may be an aerospace vehicle, such as an aircraft, satellite, spacecraft or similar vehicle, a terrestrial vehicle, watercraft or other vehicle.

Figure 2:
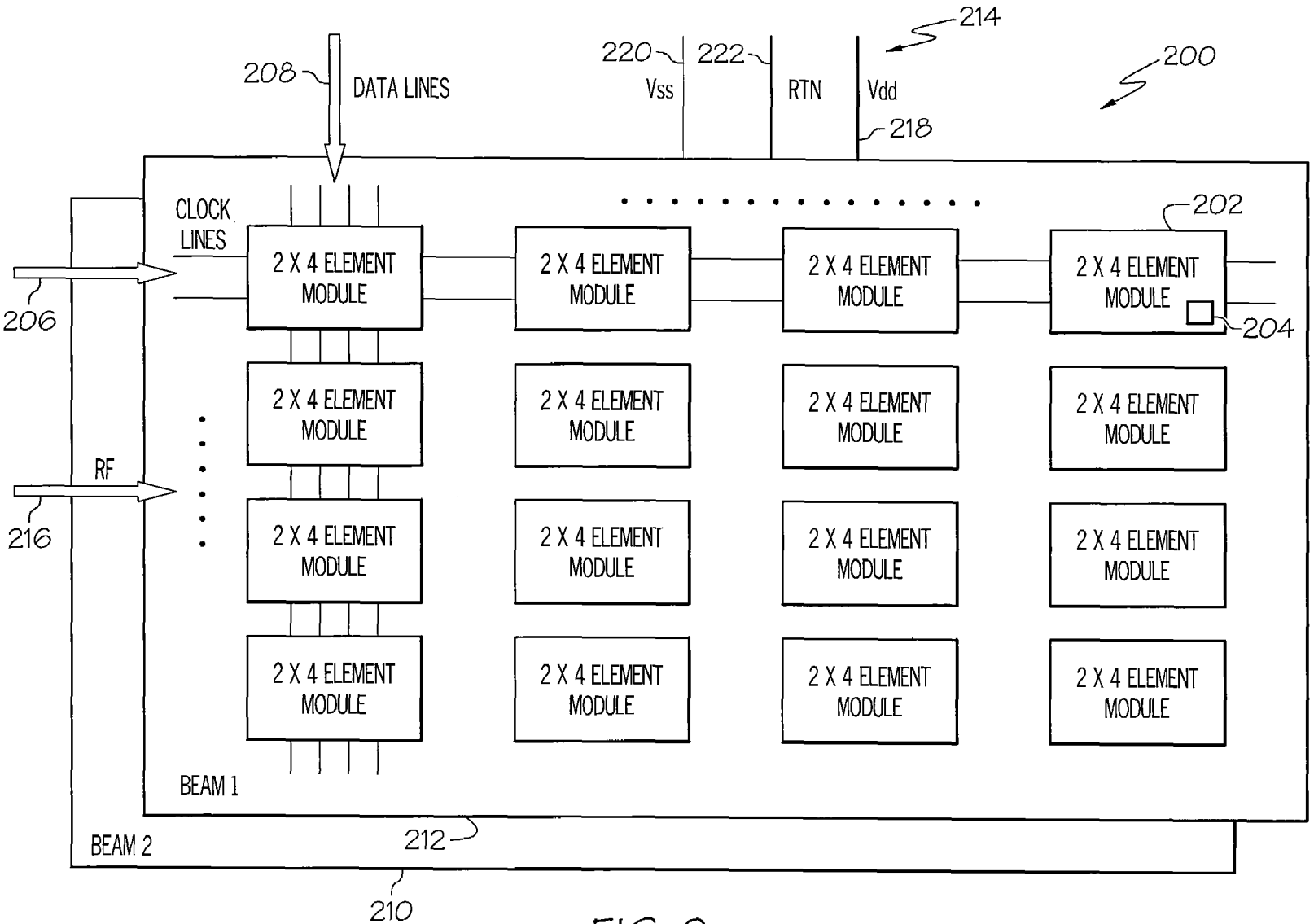
FIG. 2 is a block diagram of an exemplary multi-beam array antenna system in accordance with an embodiment of the present invention.
Figure 3A:
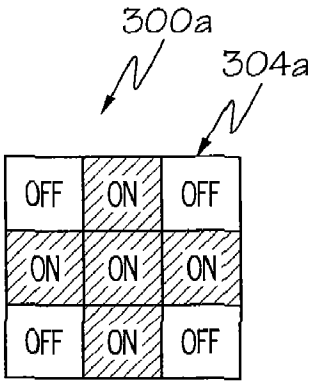
FIGS. 3A-3D are illustrations of examples of methods or different schemes for selectively powering antenna sub-arrays of a phased array antenna system for sidelobe and beam shaping control in accordance with embodiments of the present invention.
Figure 3B:
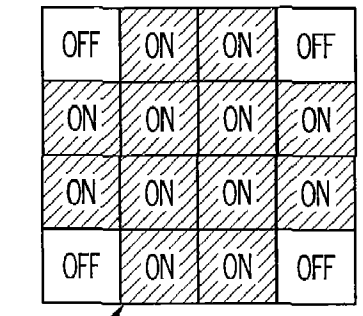
Figure 3C:
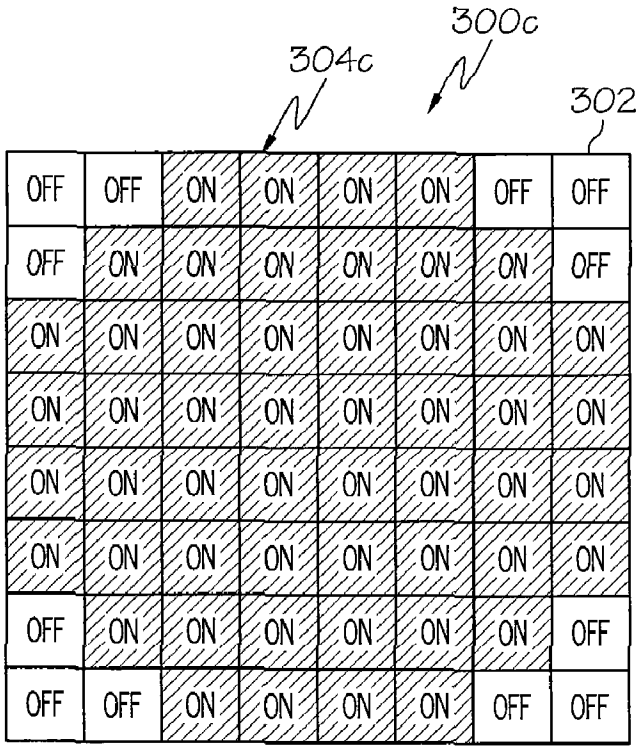
Figure 3D:
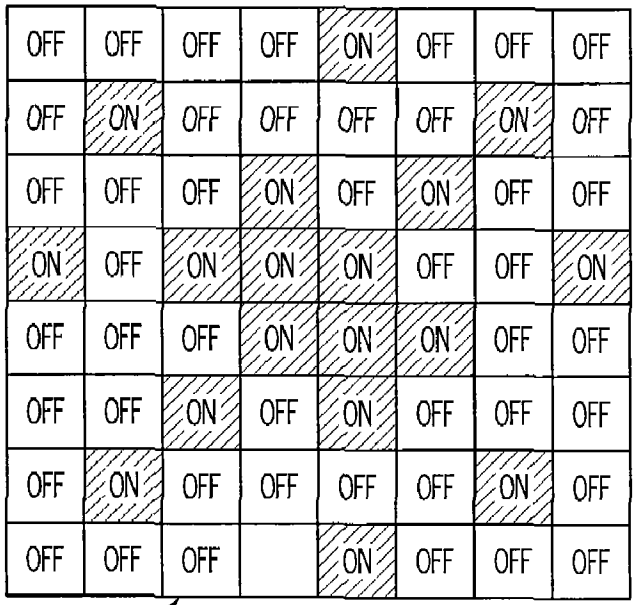

FIG. 2 is a block diagram of an exemplary array antenna system 200 in accordance with an embodiment of the present invention. The array antenna system 200 may be used for the array antenna system 104 of FIG. 1. The array antenna system 200 may include multiple array channels 210 and 212 that may generate multiple radiation beams. Only two array channels 210 and 212 (beam 1 and beam 2 respectively) are illustrated in the exemplary system 200 in FIG. 2 for purposes of explaining the present invention. The array channels 210 and 212 may be identical. Each of the two array channels 210 and 212 may contain 128 antenna elements 204 or radiation means that may be packaged into 16 modules 202. Each module 202 may include 8 antenna elements 204 that may be arranged in a 2×4 configuration or some other configuration that may be appropriate for the intended purpose or application of the antenna system 200. Each antenna element 204 may be capable of providing two independent radio frequency (RF) channels that may each include a MMIC low-noise amplifier and phase shifter, an RF transmission line and a shared radiating element (not shown in FIG. 2). These two RF channels in each antenna module 202 may form dual beams with dual polarizations, such as one for a left-hand circular polarized radiation pattern and the other for a right-hand circular polarized radiation pattern similar to radiation patterns 152 and 154 previously described with reference to FIG. 1. All the 128 elements 204 in each array channel 210 and 212 may be controlled by eight digital clock lines 206 and sixteen digital data lines 208. The clock lines 206 and the data lines 208 may be arranged in an orthogonal manner for individual element addressing and control.

A DC power distribution network 214 and a RF distribution network 216 may also be embedded in each array channel 210 and 212 to distribute electrical power to each of the elements 204 and to transmit or receive RF signals to or from each of the elements 204 depending upon whether the element is transmitting or receiving signals. The power distribution network 214 may include positive output voltage (Vdd) lines 218, negative output voltage (Vss) lines 220 and return (RTN) lines 222 or common ground of the antenna power converters, such as converters 136 and 138 in FIG. 1.

Those skilled in the art will recognize that the exemplary antenna systems 100 and 200 shown in FIGS. 1 and 2, respectively, illustrate a configuration for dual sub-array, dual-beam applications. The array architecture and power management, distribution and control system of the embodiments of the present invention described herein can be scaled to larger size arrays or systems. The configuration can be extended to full scale large arrays made of N×N sub-arrays, and variations may be adapted to other applications.

FIGS. 3A-3D are illustrations of examples of methods or different schemes 300*a*-300*d* for selectively powering antenna sub-arrays 302 of a phased array antenna system 304*a*-304*d* for sidelobe and beam shaping control in accordance with embodiments of the present invention. In addition to being reconfigurable the power management and control system of the embodiments of the present invention may provide power-efficient beam sidelobe and beam shape control for better antenna beam profile control. A conventional method of controlling antenna sidelobes is to use attenuators in the RF signal paths within the antenna modules. With this traditional approach the antenna still consumes the same DC power even though the RF signal is being attenuated.

For an antenna aperture made up of a significant number of sub-arrays 302, as shown in FIGS. 3A-3D, sidelobe and beam shape control is possible if power to each sub-array 302 can be selectively turned on or off by host commands, such as commands from the host controller 126 in FIG. 1. This new method reduces overall heat load and DC power consumption in the antenna 304, which may be important for some applications, such as space based mission critical communications where power conservation is often required.

By turning on and off the antenna sub-arrays 302 as illustrated in the exemplary schemes 300*a*, 300*b* and 300*c*, the active portion of the antenna aperture may be rounder and thus can generate a beam profile or radiation pattern closer to that of an often desirable circular aperture. By turning on and off the antenna sub-arrays 302 as illustrated in the exemplary scheme 300*d*, the antenna aperture may be rounder and with a density taper, thus enabling an additional degree of freedom in terms of power conservation. Those skilled in the art will recognize that other beam configurations or patterns may be available by controlling which sub-arrays are turned on or off.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," and "includes" and/or "including" when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. An antenna system, comprising:

a reconfigurable multiple sub-array antenna system including multiple antenna sub-arrays each capable of being electronically scanned for radio frequency communications, wherein each antenna sub-array includes a plurality of elements each capable of radiating and receiving electromagnetic energy; and an electronically reconfigurable power management and control system to selectively power each of the plurality of elements to generate a desired beam pattern, wherein the power management and control system comprises:

at least two converters each capable of being selectively coupled to each antenna sub-array; and a number of power sequencers corresponding to a number of antenna sub-arrays, each power sequencer being adapted to control a voltage supplied by any one of the converters to at least one of the antenna sub-arrays when coupled to the at least one of the antenna sub-arrays to supply power thereto.

2. The antenna system of claim 1, wherein the multiple sub-array antenna system is adapted to be reconfigurable on an antenna sub-array level during a mission.

3. The antenna system of claim 1, wherein the power management and control system comprises means to manage power consumption of each antenna sub-array.

4. The antenna system of claim 1, wherein the power management and control system comprises means for reducing prime power consumption in response to less than a total number of available antenna sub-arrays being needed.

5. The antenna system of claim 1, wherein the power management and control system comprises means for redundantly distributing required power to each antenna sub-array.

6. The antenna system of claim 1, wherein the power management and control system comprises means to control antenna beam sidelobe and antenna beam shape by powering down selected antenna sub-arrays.

7. The antenna system of claim 1, wherein the multiple sub-array antenna system is adapted to be reconfigurable on an antenna sub-array level to generate a left hand circular polarized beam pattern, a right hand circular polarized beam pattern or both.

8. The antenna system of claim 1, wherein the antenna system further comprises:

a multi-beam antenna array module to manage and control power to the antenna sub-arrays; and a host power and control module to control power to the multi-beam antenna array module.

9. The antenna system of claim 1, wherein each of the power converters are adapted to reduce a line voltage to an intermediate voltage suitable for operation of the plurality of elements of each antenna sub-array.

10. The antenna system of claim 1, wherein each of the antenna sub-arrays comprise a multiplicity of monolithic microwave integrated circuit (MMIC) devices and wherein the at least two converters are each selectively coupled to each antenna sub-array to produce a suitable voltage for the MMIC devices and to provide redundancy.

11. The antenna system of claim 1, a redundant power switch to connect a chosen one of the at least two converters to selected ones of the antenna sub-arrays.

12. The antenna system of claim 1, further comprising a power switch associated with each antenna sub-array to connect a chosen one of the at least two converters to selected ones of the antenna sub-arrays.

13. The antenna system of claim 1, wherein each power sequencer monitors an output voltage of any one of the converters, when coupled to the at least one of the antenna sub-arrays to supply power to the at least one antenna sub-array, and controls a supply voltage supplied by any one of the converters to the least one of the antenna sub-arrays when coupled to the at least one of the antenna sub-arrays to supply power thereto, the power sequencer preventing excess current from being drawn from the supply voltage supplied by any of the converters coupled to the at least one of the antenna sub-arrays.

14. The antenna system of claim 1, further comprising a power-on-reset module to generate a reset signal to hold a positive voltage supply of any one of the converters off when coupled to at least one of the antenna sub-arrays to supply power in response to a negative output voltage of any one of the converters coupled to the at least one of the antenna sub-arrays dropping below an acceptable threshold voltage during normal operation of the antenna system.

15. The antenna system of claim 1, further comprising means to generate a reset signal to hold a positive voltage supply of any one of the converters off when coupled to at least one of the antenna sub-arrays to supply power to the at least one antenna sub-array during startup until a proper level of a negative output voltage of any one of the converters coupled to the at least one of the antenna sub-arrays is at a proper voltage level.

16. The antenna system of claim 1, wherein each converter comprises a device to clamp the positive voltage supply down before the negative output voltage during a power down operation of the antenna system.

17. The antenna system of claim 1, wherein the power management and control system comprises:

a host controller to control power to the array antenna system; and a beam steering controller to control the desired beam pattern generable by the array antenna system.

18. The antenna system of claim 17, wherein the power management and control system further comprises an antenna status monitor to monitor status of the array antenna system and to report the operational status to the host controller.

19. The antenna system of claim 1, further comprising a plurality of clock lines and a plurality of data lines to control each of the plurality of elements, wherein the clock lines and data lines are arranged in an orthogonal configuration to substantially minimize cross-talk.

20. An antenna system, comprising:

a reconfigurable phased array antenna system including:

a plurality of antenna sub-arrays, and a multiplicity of elements in each antenna sub-array, each element being capable of radiating and receiving electromagnetic energy; and an electronically reconfigurable power management and control system to selectively power each of the plurality of elements to generate a desired beam pattern, the power management and control system including:

a host controller to control power to the array antenna system, a number of power sequencers corresponding to a number of antenna sub-arrays, each power sequencer being adapted to control a voltage supplied to one of the antenna sub-arrays when coupled to the one of the antenna sub-arrays, and a beam steering controller to control the desired beam pattern generated by the array antenna system.

21. The antenna system of claim 20, wherein the power management and control system comprises:

means to manage power consumption of each antenna sub-array; and means to control antenna beam sidelobe and antenna beam shape by powering down selected antenna sub-arrays.

22. The antenna system of claim 20, wherein the power management and control system comprises a module for redundantly distributing required power to each antenna sub-array.

23. The antenna system of claim 20, further comprising means to reconfigure the phased array antenna system during a mission.

24. The antenna system of claim of claim 20, wherein the antenna system is mounted to a vehicle.

25. A power management and control system for an array antenna system, comprising:

a host controller to control power to the array antenna system;

a beam steering controller to control the desired beam pattern generable by the array antenna system, wherein the array antenna system comprises a plurality of antenna sub-arrays;

at least two converters each capable of being selectively coupled to at least one of the plurality of antenna sub-arrays; and a number of power sequencers corresponding to a number of antenna sub-arrays, each power sequencer being adapted to control a voltage supplied by any one of the converters to at least one of the antenna sub-arrays when coupled to the at least one of the antenna sub-arrays to supply power thereto.

26. The power management and control system of claim 25, further comprising a power switch to selectively connect the at least two converters to chosen ones of the antenna sub-arrays.

27. The power management and control system of claim 25, further comprising a power switch associated with each antenna sub-array to connect a chosen one of the at least two converters to selected ones of the antenna sub-arrays.

28. The power management and control system of claim 25, wherein each power sequencer is adapted to monitor an output voltage of any one of the converters, when coupled to the at least one of the antenna sub-arrays to supply power to the at least one antenna sub-array, and to control a supply voltage supplied by any one of the converters to the least one of the antenna sub-arrays when coupled to the at least one of the antenna sub-arrays to supply power thereto, the power sequencer preventing excess current from being drawn from the supply voltage of any of the converters coupled to the at least one of the antenna sub-arrays.

29. The power management and control system of claim 28, further comprising a discrete power sequencer control line from the beam steering controller to each power sequencer to control the output voltage supplied by each converter.

30. The power management and control system of claim 25, further comprising a data bus to send beam pointing commands and reconfiguration control commands and beam switching commands from the host controller to the beam steering controller.

31. The power management and control system of claim 25, further comprising:

a beam steering left control line for the beam steering controller to command the array antenna system to form a left hand circular polarized radiation pattern; and a beam steering right control line for the beam steering controller to command the array antenna system to form a right hand circular polarized radiation pattern, wherein the beam steering left control line and the beam steering right control line being discrete to permit the beam steering controller to separately or simultaneously send commands for formation of the right and left hand circular polarization radiation patterns.

32. The power management and control system of claim 25, wherein the array antenna system comprises a plurality of antenna sub-arrays and further comprising:

an antenna status monitor to report an operational status of each of the antenna sub-arrays; and a display to present the operational status and other data related to operation of the array antenna system.

33. A method of controlling antenna elements in an array antenna system, comprising:

selectively powering each of a plurality of elements of a reconfigurable phased array antenna system to generate a desired beam pattern, wherein the reconfigurable phased array antenna system comprises a plurality of antenna sub-arrays;

managing power consumption in each antenna sub-array of the plurality of antenna sub-arrays in the reconfigurable phased array antenna system;

selectively coupling at least one of two converters to chosen ones of the plurality of antenna sub-arrays; and selectively coupling one of a number of power sequencers to a selected one of the plurality of antenna sub-arrays, wherein the number of power sequencers corresponds to a number of antenna sub-arrays for respectively coupling selected ones of the power sequencers to selected ones of the antenna sub-arrays, each power sequencer being adapted to control a voltage being supplied to the antenna sub-array to which the sequencer is coupled.

34. The method of claim 33, further comprising electronically reconfiguring a power management and control system to reliably power the antenna sub-arrays.

35. The method of claim 33, further comprising powering down selected antenna sub-arrays to control antenna beam sidelobe and antenna beam shape.

36. The method of claim 33, further comprising:

generating a reset signal to hold a positive supply of any one of the converters off when coupled to at least one of the antenna sub-arrays during startup of the array antenna system until a proper level of a negative output voltage of any one of the converters coupled to the at least one of the antenna sub-arrays is at a proper voltage level; and generating a reset signal to hold the positive output voltage of any one of the converters off, when coupled to at least one of the antenna sub-arrays to supply power, in response to the negative output voltage of any one of the converters coupled to the at least one of the antenna sub-arrays dropping below an acceptable threshold voltage during normal operation of the antenna.

* * * * *